US006637117B2

(12) United States Patent
Kobayashi

(10) Patent No.: US 6,637,117 B2
(45) Date of Patent: Oct. 28, 2003

(54) CHAIN SAW

(75) Inventor: Fujio Kobayashi, Tokyo (JP)

(73) Assignee: Kioritz Corporation (JP)

( * ) Notice: Subject to any disclaimer, the term of this patent is extended or adjusted under 35 U.S.C. 154(b) by 51 days.

(21) Appl. No.: 09/961,318

(22) Filed: Sep. 25, 2001

(65) Prior Publication Data

US 2002/0046468 A1 Apr. 25, 2002

(30) Foreign Application Priority Data

Oct. 10, 2000 (JP) ..... 2000-308903

(51) Int. Cl.[7] ..... B27B 17/00

(52) U.S. Cl. ..... 30/381; 30/382; 30/298.4; 30/383

(58) Field of Search ..... 30/381, 382, 383, 30/296.1, 298.4; 224/220, 255; D8/65

(56) References Cited

U.S. PATENT DOCUMENTS 5,272,813 A * 12/1993 Wolf et al. ..... 30/298.4
5,570,512 A 11/1996 Höppner
5,992,025 A * 11/1999 Fricke ..... 30/381
6,442,849 B2 * 9/2002 Taomo et al. ..... 30/383

FOREIGN PATENT DOCUMENTS

FR 2 479 069 * 10/1981

* cited by examiner

*Primary Examiner*—Hwei-Siu Payer
(74) *Attorney, Agent, or Firm*—Nixon & Peabody LLP; Donald R. Studebaker

(57) ABSTRACT

The present invention relates to a chain saw having a chain bar portion extending forwardly from a main body. The chain saw comprises an attaching portion to which a suspension member is to be attached, and the attaching portion is arranged in the vicinity of a corner portion, where a back surface and a bottom surface of the main body meet with each other, so that a longitudinal center axis of the chain bar portion may be at an angle of not greater than 20 degrees from a vertical line.

4 Claims, 4 Drawing Sheets

CHAIN SAW

BACKGROUND OF THE INVENTION

The present invention relates to a chain saw, and in particular, to a chain saw capable of being suspended by a rope or the like.

DESCRIPTION OF THE PRIOR ART

There has been known a chain saw which is driven by an air cooled two-stroke cycle internal combustion engine to cut trunks and/or branches of trees. One among those chain saws of the above-described type which is called a top-mount handle saw is generally used to trim the branches located overhead and is made light and compact so as to facilitate to lift it up even by one hand.

An operator sometimes climbs up a tree and prunes off branches by the top-mount handle saw at high locations in the tree. In that case, in order to ensure his safety, the operator needs firstly to pull a recoil starter to actuate the air cooled two-stroke cycle internal combustion engine on the ground, secondly to climb up the tree while the top-mount handle saw is left on the ground, and finally to lift up the top-mount handle saw from above in the tree by a suspension member such as a rope or the like attached thereto. Upon pulling-up the top-mount handle saw, a projected profile thereof in a pulling-up direction needs to be as small as possible in order to prevent a rotationally driven portion thereof from touching with branches and/or leaves of trees to cause it to rebound therefrom, swing like a pendulum and be unstable.

Accordingly, a first object of the present invention is to provide a chain saw which allows an operator to lift it up from above in the tree without touching with branches and leaves of trees as much as possible.

Further, a second object of the present invention is to provide a chain saw which is light in weight and compact in size.

SUMMERTY OF THE INVENTION

The first object of the present invention can be achieved by a chain saw having a chain bar portion extending forwardly from a main body, comprising: an attaching portion to which a suspension member is to be attached, the attaching portion being located in the vicinity of a corner portion where a back surface and a bottom surface of the main body meet with each other so that a longitudinal center axis of the chain bar portion forms an angle of not greater than 20 degrees with respect to a vertical line when the chain saw is suspended by the suspension member.

In the present invention, the attaching portion is disposed in the vicinity of the corner portion where the back surface and the bottom surface of the main body meet with each other, so that the longitudinal center axis may be at the angle of not greater than 20 degrees from the vertical line or an elongated axis of the suspension member when the chain saw is suspended by the suspension member. Therefore, when an operator attempts to lift up the chain saw through a gap between branches and/or leaves by pulling the suspension member from above in the tree, the chain saw can be lifted up more easily and safely without the chain bar portion largely protruding out of a projected profile of the chain saw in the pulling-up direction, which otherwise would result in contact with or catch on the branches and/or leaves.

Further, the second object of the present invention can be achieved by an chain saw having an ignition plug arranged in the vicinity of the corner portion and a cover plate portion extending from the vicinity of the corner portion so as to cover the ignition plug, and the attaching portion is formed in the cover plate portion at a location offset from the ignition plug. According to the present invention, since a free space in the plate portion deviated from the ignition plug can be used to form the attaching portion, therefore the device can be made much lighter and more compact.

DESCRIPTION OF THE PREFERRED EMBODIMENTS

Figure 1:
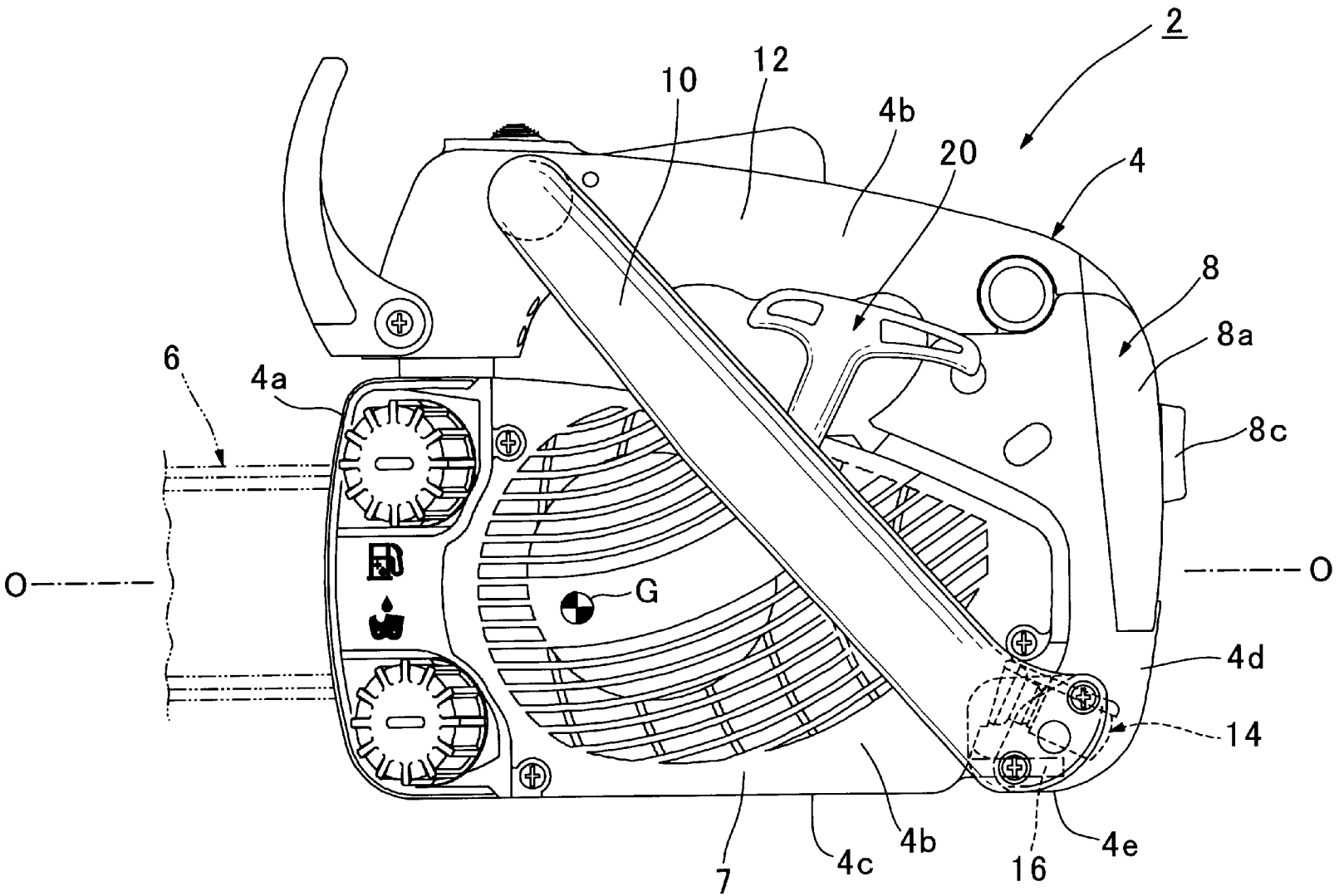
FIG. 1 is a left side elevational view of a main body of a chain saw in accordance with an embodiment of the present invention.

Referring to the drawings attached therewith, an embodiment of a chain saw according to the present invention will now be described below.

As shown in FIG. 1, a chain saw 2 has a main body 4 of a substantially rectangular box shape and a chain bar portion 6 extending forward from a front surface 4*a* of the main body 4 (partially illustrated by two-dot chain lines). A longitudinal center axis of the chain bar portion 6 is indicated O-O. An air cooled two-stroke cycle internal combustion engine which is to be actuated by a recoil starter 20, a fuel tank or the like are provided within the main body 4. An air cleaner portion 8 is provided at a rear end portion of the main body 4 with a diaphragm type carburetor being accommodated within the air cleaner portion 8, though they are not shown in detail. Further, a left side surface 4*b* of a housing 7 of the main body 4 is provided with a side handle portion 10 to be gripped by the left hand of an operator during an operation, and a top handle portion 12 being disposed on an upper side thereof extending from the front surface 4*a* to a rear surface 4*d*.

It is to be noted that the side handle portion 10 and the top handle portion 12 are mounted on the housing 7 via vibration isolation means, though not shown.

Figure 2:
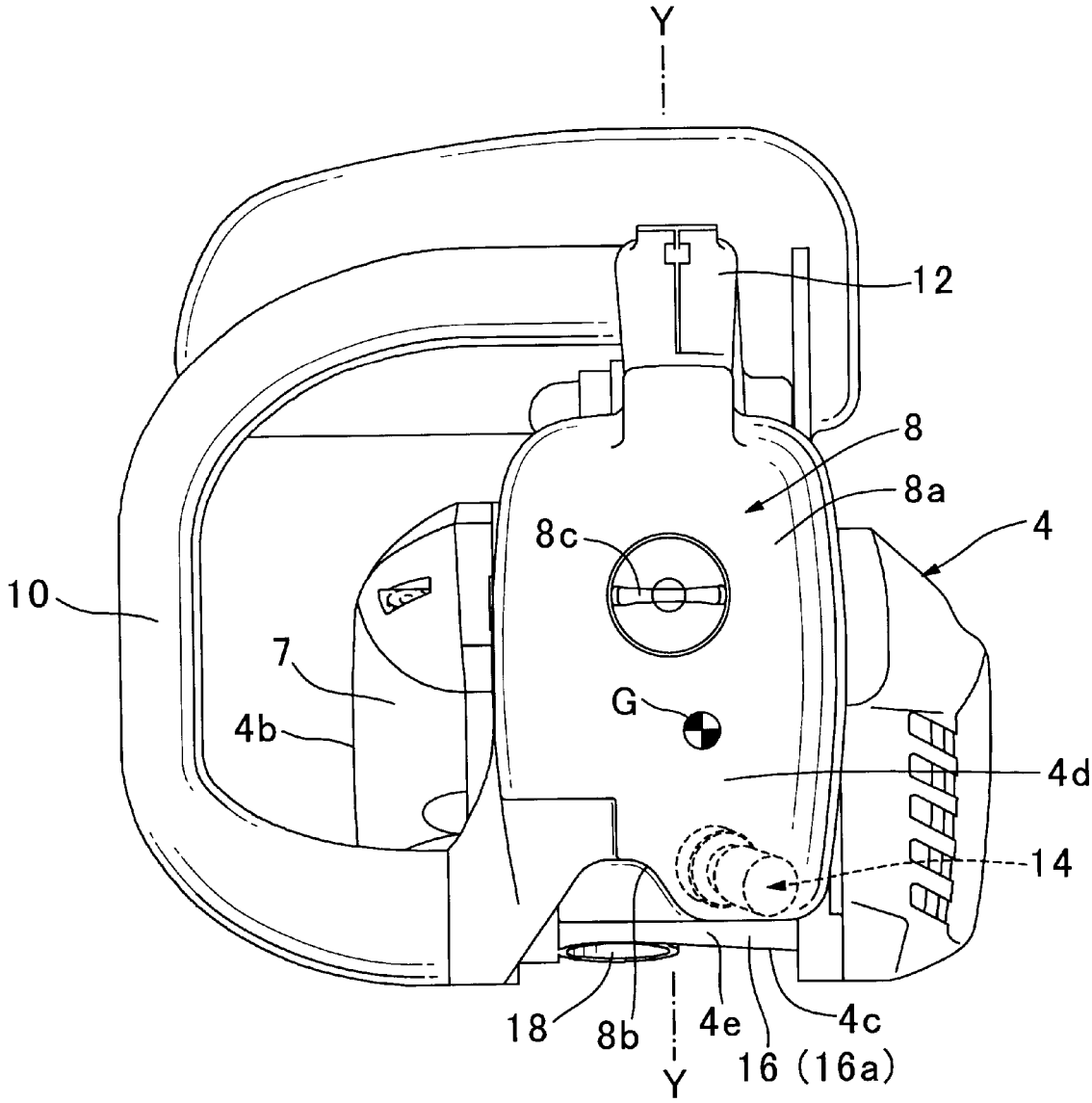
FIG. 2 is a rear elevational view of the main body of the chain saw in accordance with the embodiment of the present invention.
Figure 3:
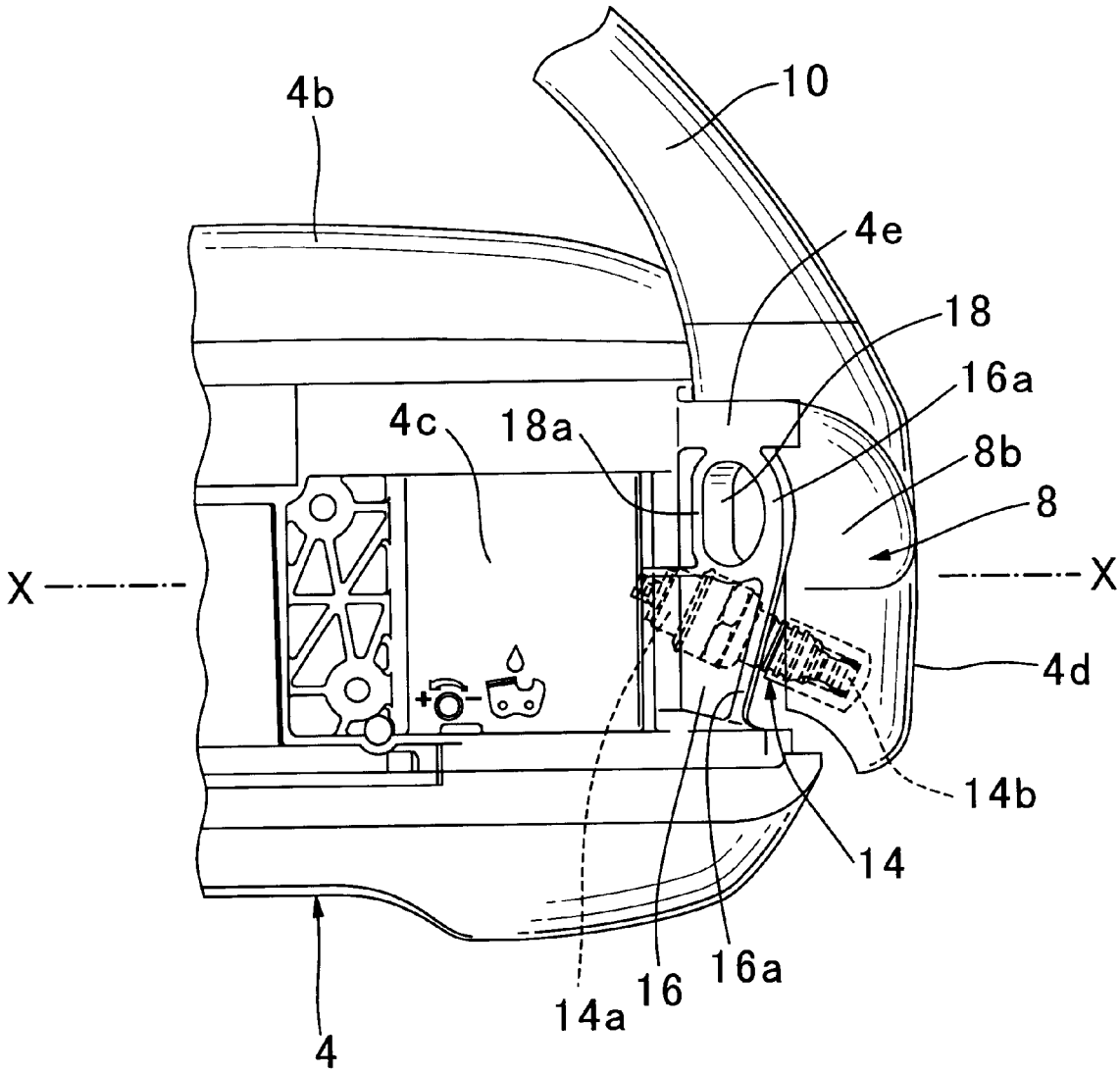
FIG. 3 is a partial bottom plan view, illustrating a rear portion of the main body of the chain saw in accordance with the embodiment of the present invention.

As is apparent from FIG. 3, in the vicinity of a corner 4*e* where a bottom surface 4*c* of the housing 7 meets with the rear surface 4*d*, an ignition plug 14 of the air cooled two-stroke cycle internal combustion engine is disposed protruding rearward. In specific, the ignition plug 14 is disposed on one side or on a right hand side (a lower side in FIG. 3) with respect to a longitudinal center axis Y-Y of the main body 4 shown in FIG. 2, and is positioned diagonally in such a direction that a line extending from a base portion 14*a*, which is engaged with the main body 4, toward a tip portion 14*b* of the ignition plug 14 gradually goes away from the longitudinal center axis Y-Y (in a right direction). The tip portion 14*b* of the ignition plug 14 is covered with an air cleaner cover 8*a* which is detachably attached to the rear surface 4*d* of the main body 4 by a screw knob 8*c*.

The housing 7 is provided with a cover plate portion 16 straightly extending rearward from the bottom surface 4*c* so as to cover a lower half portion of the ignition plug 14. The cover plate portion 16 extends not only to one side or the right hand side (the lower side in FIG. 3) with respect to the longitudinal center axis Y-Y of the main body 4 which is adjacent to the ignition plug 14, but also extends to the other side (the upper side in FIG. 3) with respect to the longitudinal center axis Y-Y and has approximately the same width as that of a flat bottom surface 4*c*. On the other hand, a hole 18 to be served as an attaching portion to which a suspension member 22 such as a rope may be attached is formed in a portion on the other side offset from the ignition plug 14, that is, a portion which is not functioning as the cover among those surfaces of the cover plate portion 16. An edge portion of the cover plate portion 16 is provided with a reinforcing rib portion 16*a* extending over a full width thereof, thereby forming an L-shape in cross-sectional view. The reinforcing rib portion 16*a* extends also to the rear side with respect to the attaching hole 18, and a reinforcing rib portion 18*a* extends along a peripheral portion of the attaching hole 18. The attaching hole 18 is formed in the cover plate portion 16 by molding. In the vicinity of the attaching hole 18 in the air cleaner cover 8*a,* a concave portion 8*b* is formed facing toward the attaching hole 18 so as to facilitate the insertion of the rope through the attaching hole 18.

Figure 4:
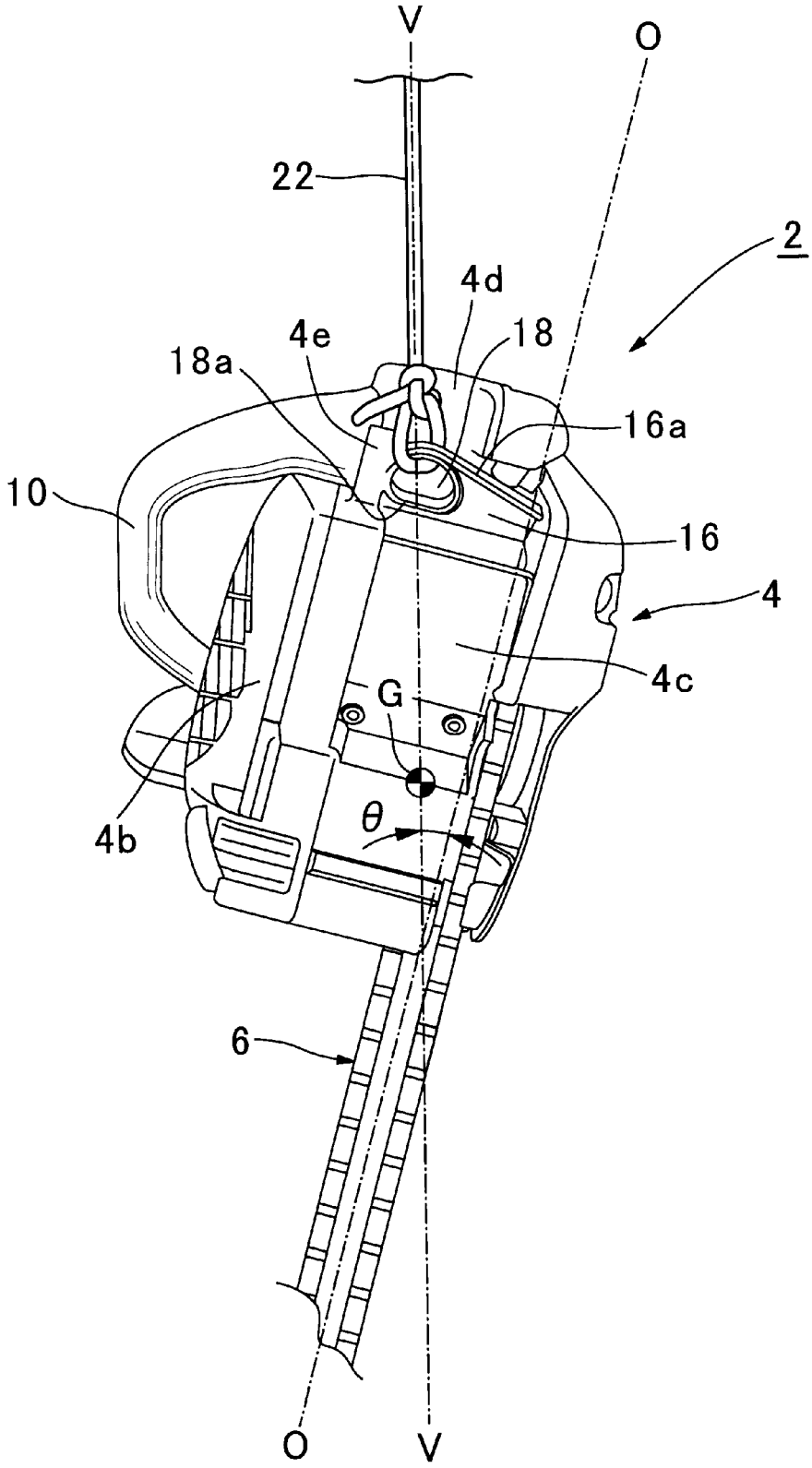
FIG. 4 shows the chain saw being suspended by a rope attached to an attaching hole.

As can be seen from FIG. 4, in the chain saw 2 according to the present invention, a rope 22 can be tied to the attaching hole 18 to hang the machine body. An operator, upon working at a high location in a tree to prune branches, he firstly pulls a recoil starter 20 to actuate the air cooled two-stroke cycle internal combustion engine and leaves the chain saw 2 on the ground. The operator, for example, ties a tip portion of the rope 22 around his or her waist and climbs up the tree. He or she, then, pulls the rope to lift up the chain saw 2. It is preferable that the chain saw is lifted up in such a way that the longitudinal center axis O-O is oriented in an up and down direction in order to allow the chain saw 2 to be lifted up easily through a narrow gap between the branches and leaves. FIGS. 1 and 2 show a center of gravity G of the chain saw 2 according to the embodiment of the present invention. As is obvious from FIG. 2, the attaching hole 18 has been arranged in the vicinity of the corner 4*e* where the bottom surface 4*c* and the back surface 4*d* of the main body 4 meet with each other. That is, the attaching hole 18 is located at a place closest to the center of gravity G shown in FIG. 2 among those places of structural portions of the main body 4 having sufficient strength required to support the main body 4.

As shown in FIG. 4, when the rope 22 is attached to the attaching hole 18 and the chain saw 2 according to the embodiment of the present invention is suspended, the longitudinal center axis O-O forms an angle "θ" of not greater than 20 degrees, preferably, about 15 degrees, from a vertical line V-V or the extension line of the rope 22 which goes through the center of gravity G.

According to the embodiment of the present invention, when the chain saw 2 is suspended, the longitudinal center axis O-O is at an angle of approximately 15 degrees from the vertical line V-V. Accordingly, this prevents the chain bar portion 6 from protruding out of the contour of the main body 4 when the chain saw 2 is viewed from the rear surface 4*d* side, which allows the operator to lift up the chain saw 2 more easily through the narrow gap between the branches and/or leaves. Further, since the chain bar portion 6, which is being driven, is hardly touch the branches and/or leaves, a possible incident of the chain saw 2 swinging to be unstable on the rebound of the touch with the branches and/or leaves may also be eliminated.

Still further, according to the embodiment of the present invention, since the attaching hole 18 is formed in the cover plate portion 16 by way of the integral molding, therefore the ignition plug 14 may also be effectively protected, the number of components may be reduced and the chain saw 2 may be manufactured at lower cost.

The present invention has thus been shown and described with reference to specific embodiments. However, it should be noted that the arrangements but changes and modifications may be made without departing from the scope of the appended claims.

For example, although in the embodiment, the attaching portion 18 is formed in the cover plate portion 16 and it is preferable in the viewpoint of making the chain saw 2 compact and reducing the number of components. However, the attaching portion 18 can be formed as a separate component and can be installed at any suitable location on the main body 4 so that the angle of inclination is smaller than 20 degrees.

In addition, although it is preferable that the attaching portion 18 is provided in the cover plate portion 16 from the viewpoint of making the device more compact, the attaching portion 18 is not necessarily arranged in the cover plate portion 16 so far as it is disposed in the vicinity of the corner 4*e* where the bottom surface 4*c* and the back surface 4*d* of the main body 4 meet with each other.

Further, in the embodiment of the present invention, it is preferable that, when the chain saw 2 is suspended, an angle of inclination of the longitudinal center axis O-O with respect to the vertical line V-V should be as small as possible. The angle in the above embodiment is 15 degrees. Preferably, the angle of inclination should not be greater than 20 degrees so as to lift up the chain saw 2 possibly without touching the branches and/or leaves. It is to be noted that chain saws similar to the chain saw 2 so-called "a top-mount handle saw" which are often used up in a tree have more or less the similar configuration and the locations of the center of gravity G are located at substantially similar locations.

In addition, the attaching portion 18 may be formed in any shapes so far as the suspension member 22 can be attached thereto. Although it is formed in a hole in the present embodiment, it can be formed in other shapes such as a hook.

Further, the suspension member 22 may be directly coupled to the attaching portion 18. Alternatively any suspension member 22 such as a chain or the like that can be connected to the attaching portion 18 via a connecting member such as a hook may be used.

What is claimed is:

1. A chain saw having a chain bar portion extending forwardly from a main body, comprising:

an attaching portion to which a suspension member is to be attached, said attaching portion being located in the vicinity of a corner portion where a back surface and a bottom surface of said main body meet with each other so that a longitudinal center axis of said chain bar portion forms an angle of not greater than 20 degrees with respect to a vertical line when said chain saw is suspended by said suspension member; and an ignition plug arranged in the vicinity of the corner portion and a cover plate portion extending from the vicinity of the corner portion so as to cover said ignition plug, and said attaching portion is formed in said cover plate portion at a location offset from said ignition plug.

2. A chain saw in accordance with claim 1, wherein said cover plate portion has a reinforcing rib portion extending over a full width thereof.

3. A chain saw having a chain bar portion extending forwardly from a main body, comprising:

an attaching portion to which a suspension member is to be attached, said attaching portion being located in the vicinity of a corner portion where a back surface and a bottom surface of said main body meet with each other so that said chain bar portion does not protrude out of a contour of said main body as viewed from a rear side of said main body which is suspended by said suspension member; and an ignition plug arranged in the vicinity of the corner portion and a cover plate portion extending from the vicinity of the corner portion so as to cover said ignition plug, and said attaching portion is formed in said cover plate portion at a location offset from said ignition plug.

4. A chain saw in accordance with claim 3, wherein said cover plate portion has a reinforcing rib portion extending over a full width thereof.

* * * * *